US009278781B1

(12) United States Patent
Boldis

(10) Patent No.: US 9,278,781 B1
(45) Date of Patent: Mar. 8, 2016

(54) STACKABLE INTERLOCKING VESSEL

(71) Applicant: John F. Boldis, Merrick, NY (US)

(72) Inventor: John F. Boldis, Merrick, NY (US)

( * ) Notice: Subject to any disclaimer, the term of this patent is extended or adjusted under 35 U.S.C. 154(b) by 0 days.

(21) Appl. No.: 14/331,683

(22) Filed: Jul. 15, 2014

(51) Int. Cl.
*B65D 21/00* (2006.01)
*B65D 21/02* (2006.01)

(52) U.S. Cl.
CPC ..... *B65D 21/0231* (2013.01)

(58) Field of Classification Search
CPC ..... B65D 21/0231; B65D 21/0233; B65D 21/0209; B65D 21/0213; A47K 19/23; Y10T 29/49826
USPC ..... 215/10; 220/23.83, 23.87; 206/503, 509
See application file for complete search history.

(56) References Cited

U.S. PATENT DOCUMENTS

| | | | | | |
|---|---|---|---|---|---|
| 475,231 | A * | 5/1892 | Anderson | 220/4.26 |
| 769,615 | A * | 9/1904 | Kosansvich | 215/10 |
| 896,903 | A | 8/1908 | Ferry | |
| 2,488,611 | A * | 11/1949 | Stallings | 215/10 |
| 2,514,573 | A * | 7/1950 | Harrison | 220/4.24 |
| 3,067,896 | A * | 12/1962 | Berg et al. | 215/12.1 |
| 3,143,205 | A * | 8/1964 | Ruderian | 206/543 |
| 3,369,691 | A * | 2/1968 | Wei | 220/4.27 |
| 4,984,723 | A | 1/1991 | Hsu | |
| 5,417,327 | A * | 5/1995 | Saumure | 206/427 |
| 5,887,740 | A * | 3/1999 | Hong | 220/4.27 |
| 6,161,355 | A | 12/2000 | Gratt | |
| D439,156 | S | 3/2001 | Hall et al. | |
| 8,544,649 | B2 | 10/2013 | Rivera et al. | |
| 2004/0020890 | A1 * | 2/2004 | Tan et al. | 215/356 |
| 2004/0262306 | A1 * | 12/2004 | Smith | 220/4.26 |
| 2006/0096942 | A1 | 5/2006 | Lane | |
| 2006/0255000 | A1 | 11/2006 | Quintana | |
| 2007/0012693 | A1 * | 1/2007 | Kummer | 220/4.27 |
| 2009/0045157 | A1 * | 2/2009 | Panchal et al. | 215/10 |
| 2009/0127152 | A1 * | 5/2009 | Bou-Mezrag | 206/507 |
| 2009/0266782 | A1 | 10/2009 | Lane | |
| 2010/0200438 | A1 * | 8/2010 | Davies | 206/223 |
| 2010/0300916 | A1 * | 12/2010 | Alvares et al. | 206/509 |
| 2011/0186585 | A1 * | 8/2011 | Lu | 220/575 |
| 2011/0226719 | A1 * | 9/2011 | Park | 215/10 |
| 2012/0018337 | A1 * | 1/2012 | Furey | 206/520 |
| 2012/0308357 | A1 | 12/2012 | Friesen et al. | |
| 2013/0111726 | A1 * | 5/2013 | Krieger | 29/428 |
| 2013/0240401 | A1 * | 9/2013 | Hall | 206/509 |
| 2014/0027336 | A1 * | 1/2014 | Bou Mezrag et al. | 206/519 |
| 2014/0061150 | A1 * | 3/2014 | Park | 215/378 |
| 2014/0224757 | A1 * | 8/2014 | McWhorter et al. | 215/10 |

* cited by examiner

*Primary Examiner* — Steven A. Reynolds
(74) *Attorney, Agent, or Firm* — Richard L. Miller

(57) ABSTRACT

A container that is interlockingly stackable and self-sealing. The container includes a body, an upper interlock component, and a lower interlock component. The upper interlock component extends outwardly from the body. The lower interlock component extends inwardly from the body and replaceably receives the upper interlock component of a next lower container so as to allow the container to be interlockingly stacked and self-sealed. In a first embodiment, the container is a bottle, and in a second embodiment, the container is a can.

22 Claims, 10 Drawing Sheets

STACKABLE INTERLOCKING VESSEL

BACKGROUND OF THE INVENTION

1. Field of the Invention

The present invention relates to a vessel, and more particularly, a stackable interlocking vessel.

2. Description of the Prior Art

Numerous innovations for interlocking containers have been provided in the prior art that will be described. Even though these innovations may be suitable for the specific individual purposes to which they address, however, they differ from the present invention.

A FIRST EXAMPLE, U.S. Pat. No. 896,903, Published/Issued on Aug. 25, 1908, to Ferry teaches a combination bottle and drinking cup. The drinking cup sheaths the lower portion of the bottle and has a waxy inner surface that renders the drinking cup impervious to liquid and causes the drinking cup to cling to the bottle.

A SECOND EXAMPLE, U.S. Pat. No. 4,984,723, Published/Issued on Jan. 15, 1991, to Hsu teaches an assembly of beverage bottle/can and cup including a beverage bottle or can for containing the beverage and a cup for encasing the lower part of the bottle or can to be integrated as one body. A plurality of parallel linear projections are provided to the inner wall at the upper part of cup whereon a plurality of vent grooves are spaced in a suitable distance in the direction perpendicular to the projections, and a clip is provided to the outer upper edge of cup.

A THIRD EXAMPLE, U.S. Pat. No. 6,161,355, Published/Issued on Dec. 19, 2000, to Gratt teaches a system of tracks, brackets, and containers, typically empty beverage cans, assembled and used for temporary storage, temporary emergency shelters, toys, or other uses involving inexpensive and light-weight building materials. The system is implemented by releasably attaching the containers to the tracks, then releasably attaching the tracks to each other either horizontally, vertically, or both to form structural elements, such as beams, columns, or panels. The rigid tracks are made from a material that allows for apertures in the tracks to be sized to resiliently snap onto portions of the containers. The track is formable in a variety of different shapes, such as straight-shaped, angle-shaped, curve-shaped, T-shaped, or cross-shaped. Additionally, the brackets are formable in a variety of different shapes to attach the track assemblies to each other in various orientations.

A FOURTH EXAMPLE, U.S. Pat. No. 8,544,649, Published/Issued on Oct. 1, 2013, to Rivera, et al. teaches stackable containers that, in various embodiments, are adapted to be vertically and/or horizontally interlocked with other, like, containers. In one embodiment, a stackable container includes a top surface having a shoulder portion that extends upwardly from the top surface and that is substantially disposed within a perimeter defined by the top surface, a bottom surface defining a stacking recess, and a plurality of substantially vertical side surfaces that extend between the top surface and the bottom surface. In various embodiments, a recessed portion of the bottom surface adjacent the stacking recess is adapted to substantially mate with at least a portion of a shoulder portion of a like container.

A FIFTH EXAMPLE, U.S. Patent Office Document No. D439,156, Published/Issued on Mar. 20, 2001, to Hall, et al. teaches the ornamental design for a set of interlocking bottles.

A SIXTH EXAMPLE, U.S. Patent Office Document No. 2006/0096942, Published/Issued on May 11, 2006, to Lane teaches a stackable bottle for use with liquids or other consumable materials. A system of the stackable bottles features nesting bottles having interlocking upper and lower surfaces, interlocking side walls, and integral handles. Each bottle has generally planar side walls to permit optimization of stack volume. The bottles are designed to be stacked in an upright position to reduce spillage from the neck of each bottle. Interlocks provide a locational transition fit engagement for connection and disconnection.

A SEVENTH EXAMPLE, U.S. Patent Office Document No. 2006/0255000, Published/Issued on Nov. 16, 2006, to Quintana teaches a water bottle that includes an intruding bottom portion allowing entry of a spout portion of another water bottle, and stacking surfaces for supporting vertically stacked water bottles. The water bottle neck is shaped for inverted cooperation with a water dispenser to release the water for drinking or cooking. An outside stacking surface at the bottom of the spout portion cooperates with an inside stacking surface at the base of the water bottle. The water bottle includes a molded-in handle, and the spout portion includes inside threads for a screw-on cap.

AN EIGHTH EXAMPLE, U.S. Patent Office Document No. 2009/0266782, Published/Issued on Oct. 29, 2009, to Lane teaches a bottle having a storage chamber defined by spaced upper and lower surfaces and planar sidewalls. A conical ceiling in the upper surface has an opening at the top thereof. A conical convex recess in the lower surface is for receiving the conical ceiling of the next adjacent bottle when stacking the bottles. Apparatus interlocks the sides and upper and lower surfaces of the bottles when stacked. The bottle may have ribs in the conical ceiling, conical recess, and sidewalls for increasing top load resistance. A plurality of bottles are assemblable into a bottle stack.

A NINTH EXAMPLE, U.S. Patent Office Document No. 2012/0308357, Published/Issued on Dec. 6, 2012, to Friesen, et al. teaches a stackable container including a body with an upper section having a plurality of upper wall panels, a lower section having a plurality of lower wall panels, and a middle section positioned between the upper section and the lower section, which has a plurality of middle wall panels and a bottom surface connected to the lower section. A container neck is connected to the upper section of the body. The container also includes a cap removably engaged with the neck. The bottom section includes a recess. The recess and the cap are configured so that there is interconnection between the cap of one container and the recess of a diagonally adjacent container.

It is apparent now that numerous innovations for interlocking containers have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a stackable interlocking vessel that avoids the disadvantages of the prior art.

ANOTHER OBJECT of the present invention is to provide a stackable interlocking vessel that is simple and inexpensive to manufacture.

STILL ANOTHER OBJECT of the present invention is to provide a stackable interlocking vessel that is simple to use.

BRIEFLY STATED, STILL YET ANOTHER OBJECT of the present invention is to provide a container that is interlockingly stackable and self-sealing. The container includes a body, an upper interlock component, and a lower interlock component. The upper interlock component extends outwardly from the body. The lower interlock component extends inwardly from the body and replaceably receives the upper interlock component of a next lower container so as to allow the container to be interlockingly stacked and self-sealed. In a first embodiment, the container is a bottle, and in a second embodiment, the container is a can.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
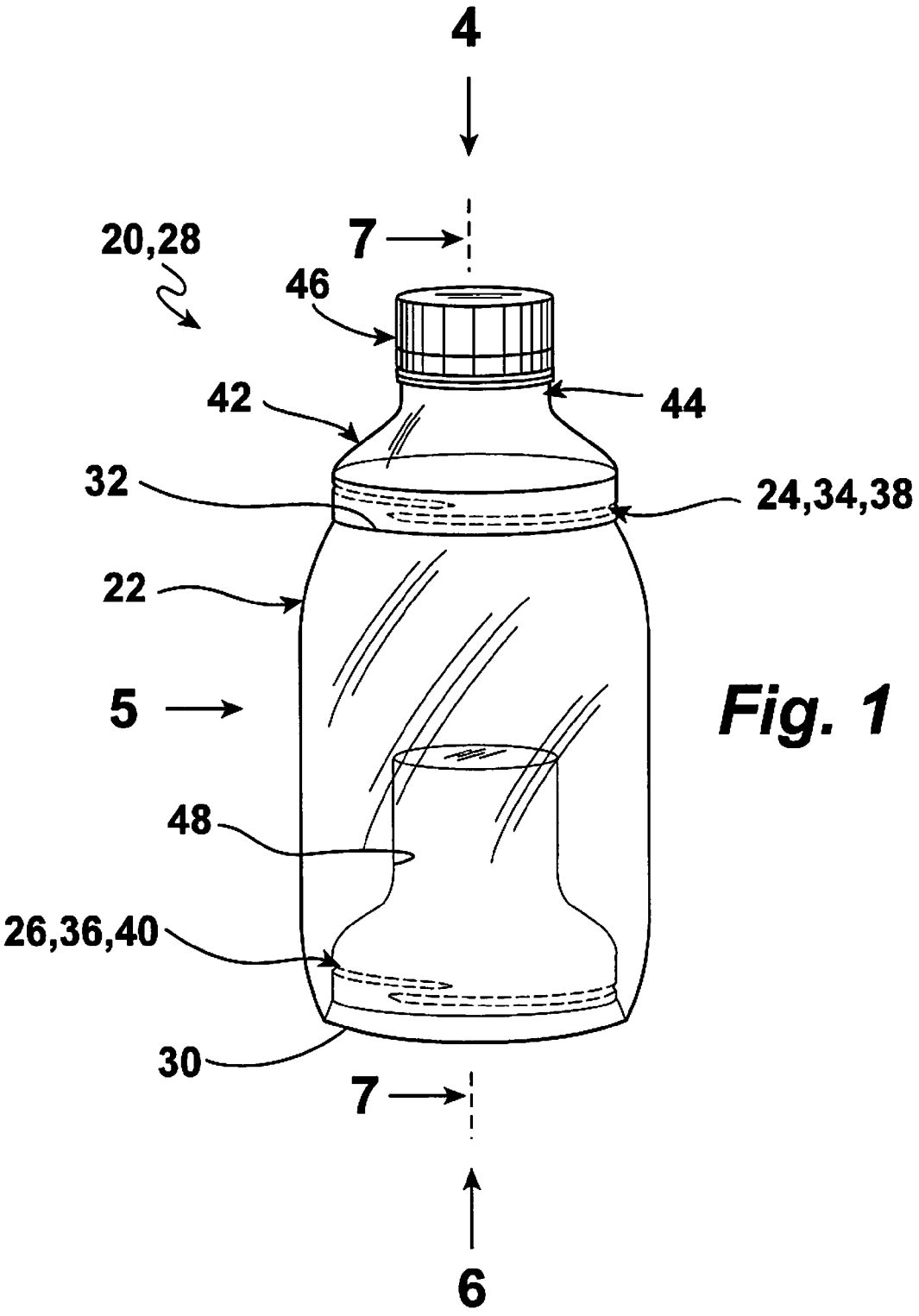
FIG. 1 is a diagrammatic perspective view illustrating a bottle first embodiment of a stackable interlocking vessel of the present invention.

20 container of first embodiment of present invention for being interlockingly stackable and self-sealing
22 body
24 upper interlock component
26 lower interlock component
28 bottle
30 lowermost end of body 22
32 uppermost end of body 22
34 threads of upper interlock component 24
36 threads of lower interlock component 26
38 male threads of threads 34 of upper interlock component 24
40 female threads of threads 36 of lower interlock component 26
42 circumferential shoulder
44 neck
46 cap
48 recess of lowermost end 30 of body 22
120 container of second embodiment of present invention for being interlockingly stackable and self-sealing
122 body
124 upper interlock component
126 lower interlock component
128 can
130 lowermost end of body 122
132 uppermost end of body 122
134 threads of upper interlock component 124
136 threads of lower interlock component 126
138 male threads of threads 134 of upper interlock component 124
140 female threads of threads 136 of lower interlock component 126
142 circumferential shoulder
144 neck
146 pop-top
148 recess of lowermost end 130 of body 122

DETAILED DESCRIPTION OF THE PREFERRED EMBODIMENT

Figure 2:
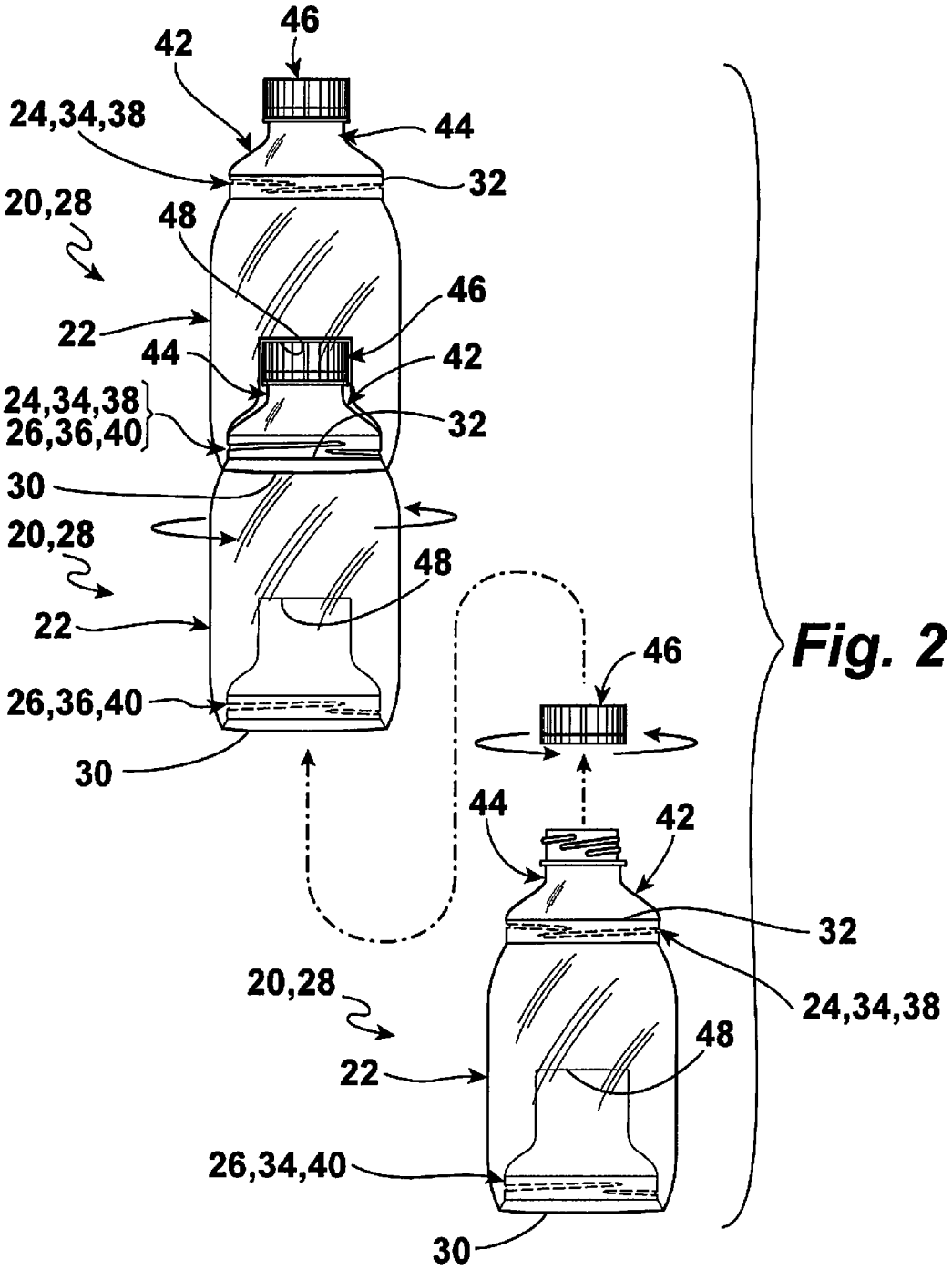
FIG. 2 is a side elevational view thereof illustrating three Stackable interlocking vessels in various stages of cooperation with each other.
Figure 3:
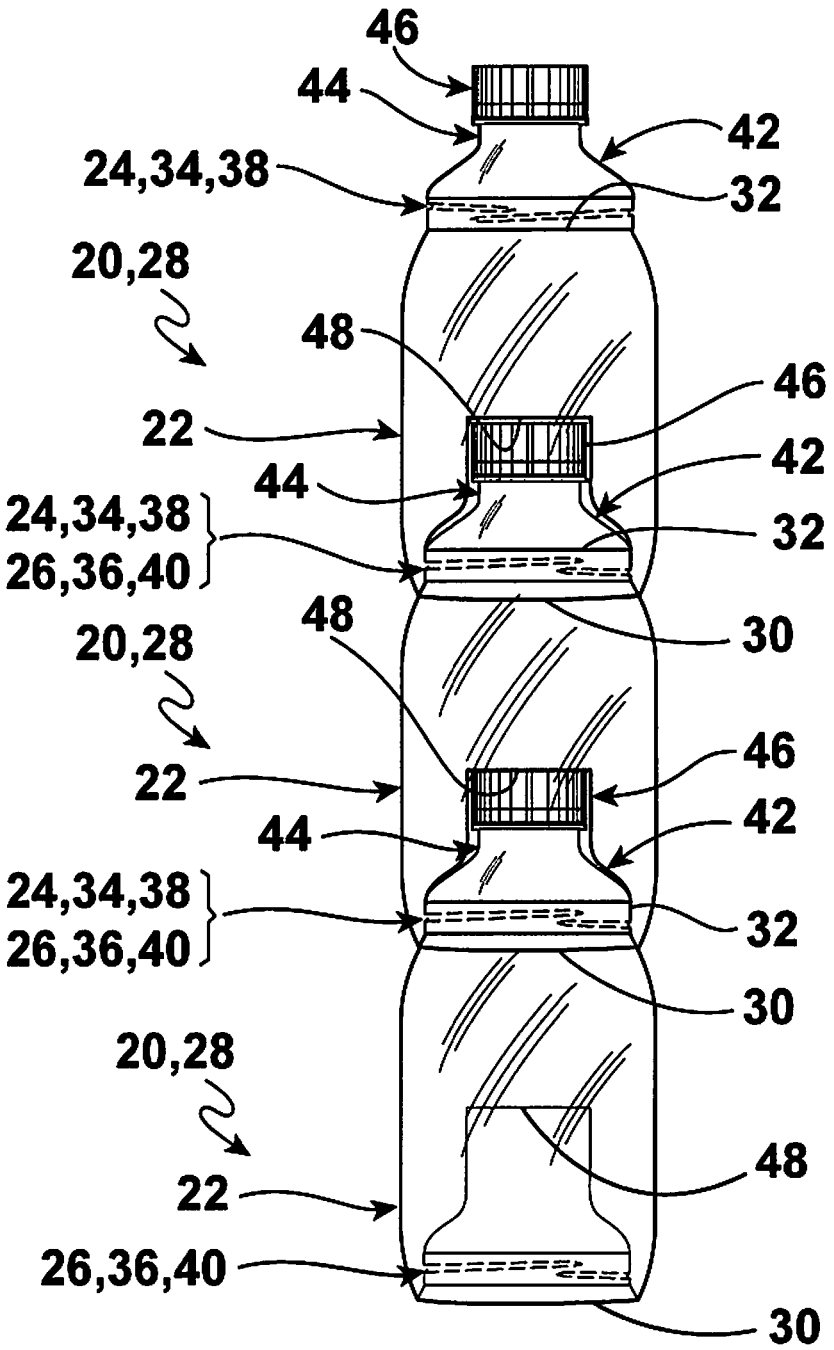
FIG. 3 is a side elevational view thereof illustrating three Stackable interlocking vessels interlocked and secured to each other.
Figure 4:
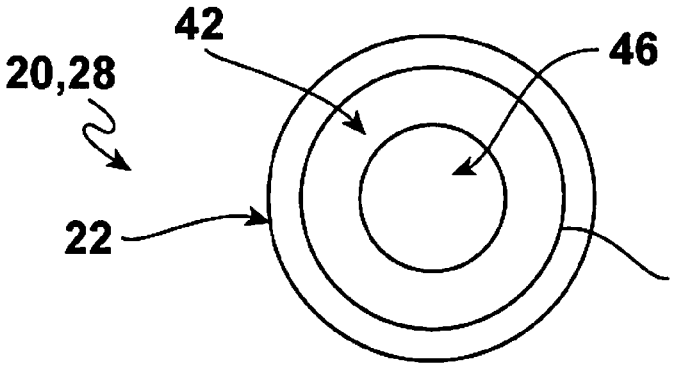
FIG. 4 is a top plan view thereof, taken in the direction of arrow 4 in FIG. 1.
Figure 5:
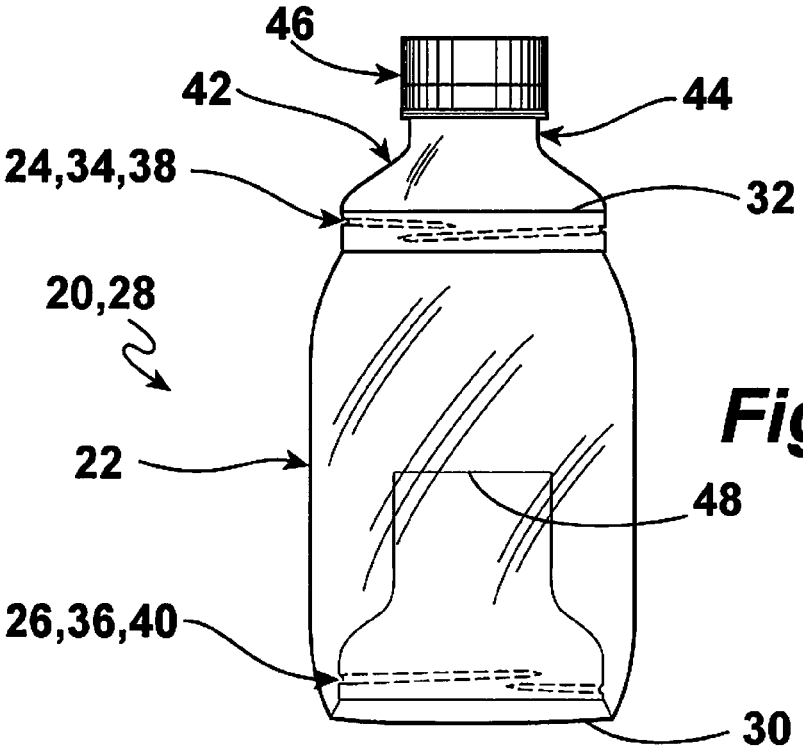
FIG. 5 is a side elevational view thereof, taken in the direction of arrow 5 in FIG. 1.
Figure 6:
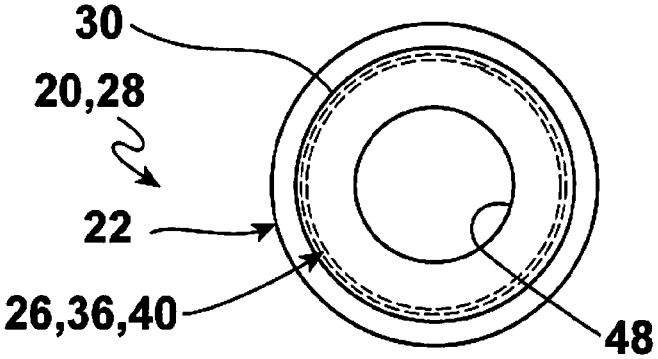
FIG. 6 is a bottom plan view thereof, taken in the direction of arrow 6 in FIG. 1.
Figure 7:
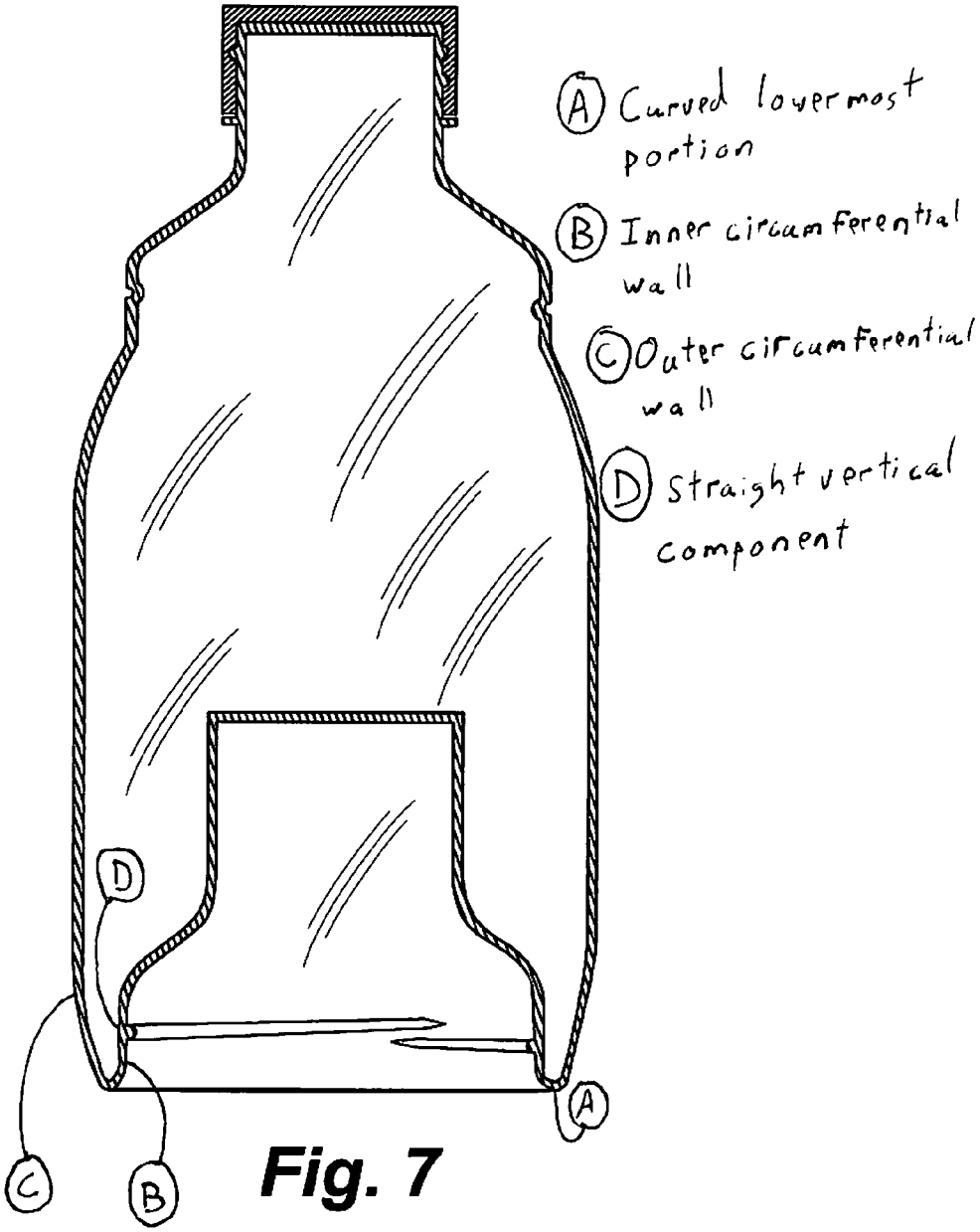
FIG. 7 is a cross sectional view thereof, taken along line 7-7 in FIG. 1.

Referring now to the figures, in which like numerals indicate like parts, and particularly to FIGS. 1-7, the container of the first embodiment of the present invention is shown generally at 20 for being interlockingly stackable and self-sealing.

The container 20 comprises a body 22, an upper interlock component 24, and a lower interlock component 26. The upper interlock component 24 extends outwardly from the body 22. The lower interlock component 26 extends inwardly from the body 22 and replaceably receives the upper interlock component 24 of a next lower container 20 so as to allow the container 20 to be interlockingly stacked and self-sealed.

The container 20 is a bottle 28.

The body 22 has a lowermost end 30 and an uppermost end 32.

The upper interlock component 24 extends outwardly, coaxially, and communicatingly from the uppermost end 32 of the body 22.

The lower interlock component 26 extends inwardly, coaxially, and communicatingly into the lowermost end 30 of the body 22.

The upper interlock component 24 includes threads 34.

The lower interlock component 26 includes threads 36.

The threads 34 of the upper interlock component 24 are male threads 38.

The threads 36 of the lower interlock component 26 are female threads 40.

The container 20 further comprises a circumferential shoulder 42.

The circumferential shoulder 42 extends coaxially, convergingly upwardly, and communicatingly from, and around, the upper interlock component 24.

The container 20 further comprises a neck 44.

The neck 44 extends coaxially upwardly and communicatingly from the circumferential shoulder 42.

The container 20 further comprises a cap 46.

The cap 46 is threadably attached to the neck 44 so as to be replaceably attached thereto.

The circumferential shoulder 42, the neck 44, and the cap 46 form a general shape.

The lowermost end 30 of the body 22 further has a recess 48.

The recess 48 of the lowermost end 30 of the body 22 has a general shape to match the general shape of the circumferential shoulder 42, the neck 44, and the cap 46 so as to nestle the circumferential shoulder 42, the neck 44, and the cap 46 of a next lower container 20 therein, and be replaceably maintained therein, by the lower interlock component 26 of the container 20 threadably engaging the upper interlock component 24 of the next lower container 20.

Figure 8:
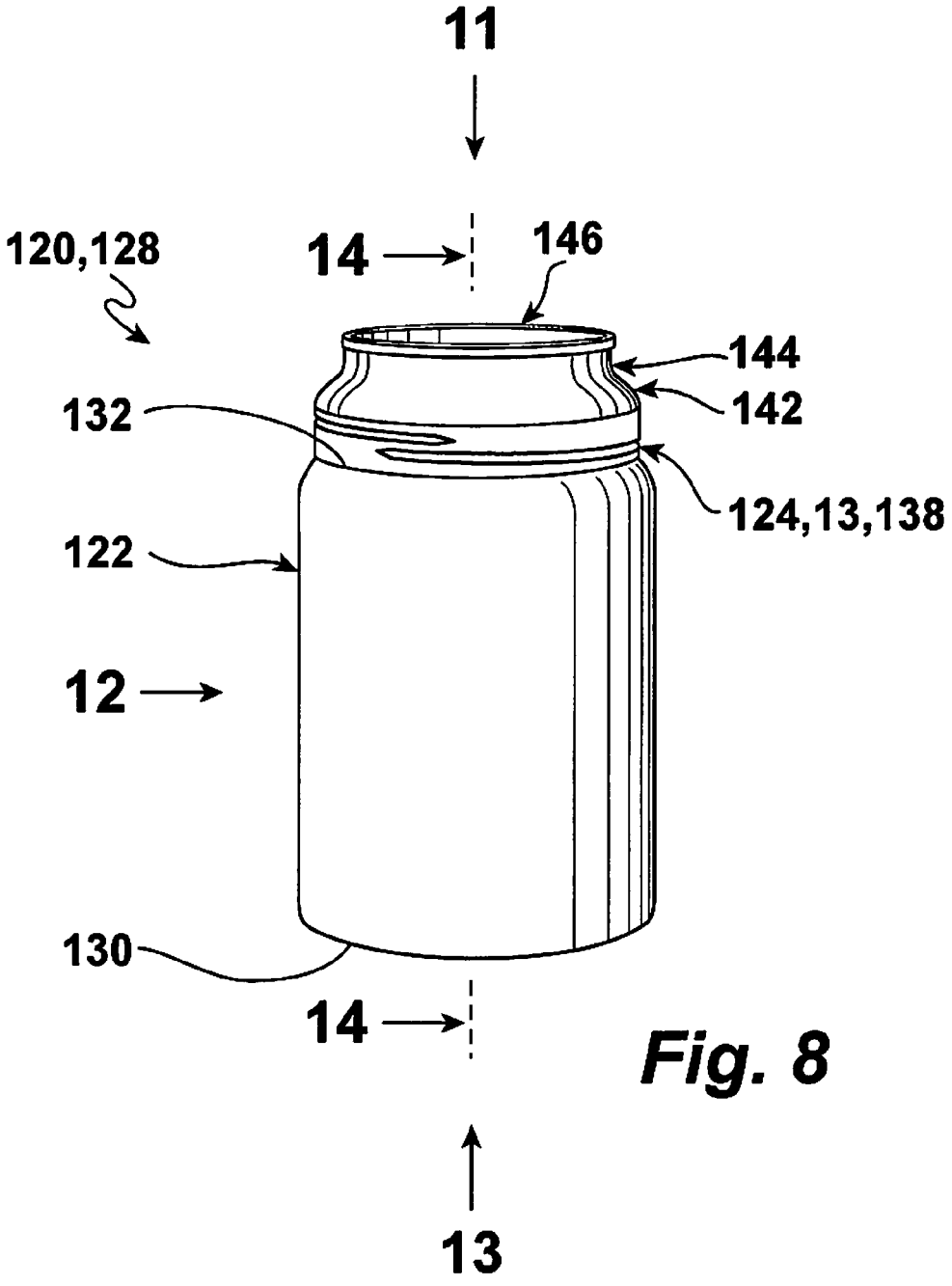
FIG. 8 is a diagrammatic perspective view illustrating a can second embodiment of a stackable interlocking vessel of the present invention.
Figure 9:
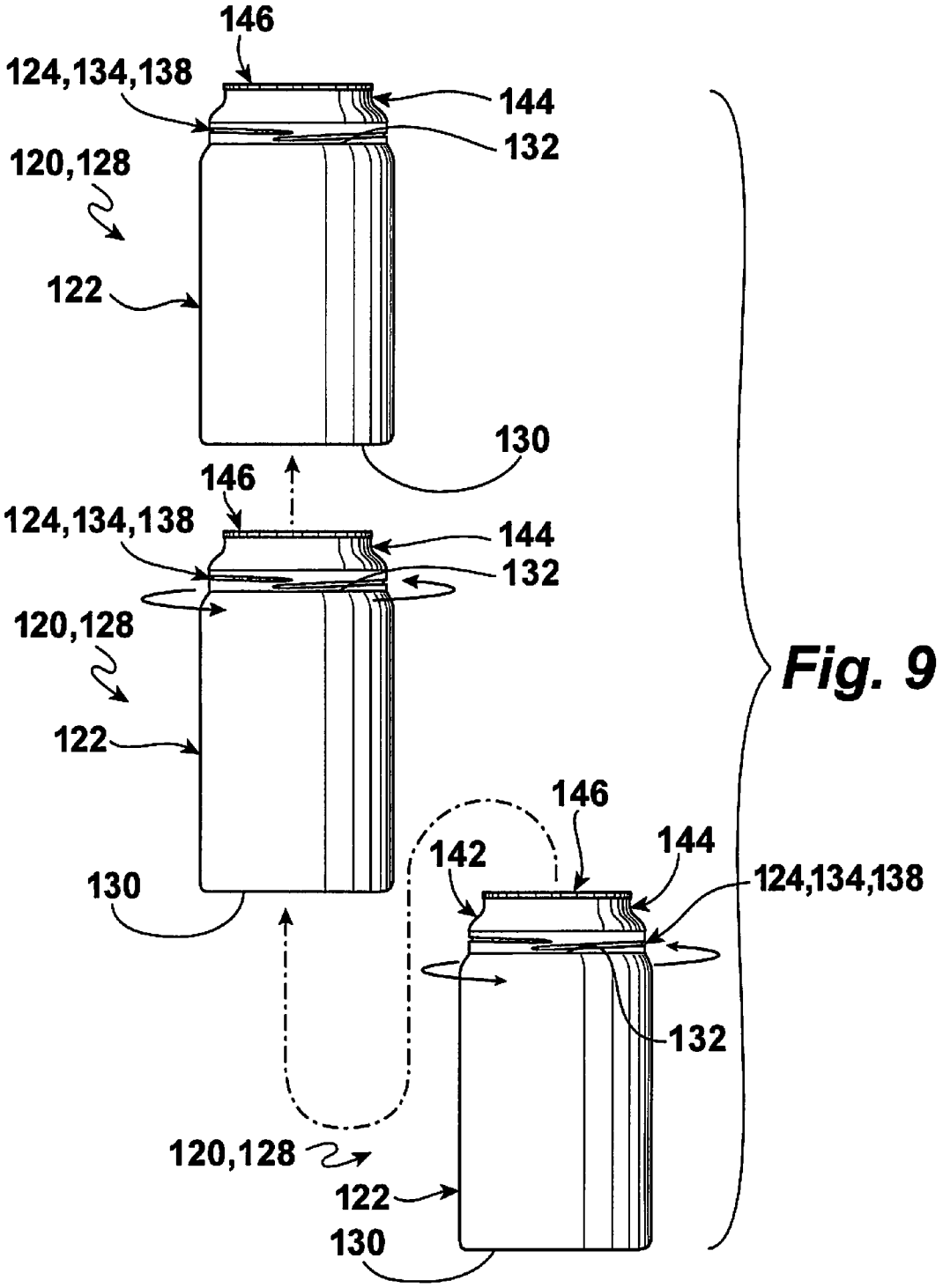
FIG. 9 is a side elevational view thereof illustrating three Stackable interlocking vessel in various stages of cooperation with each other.
Figure 10:
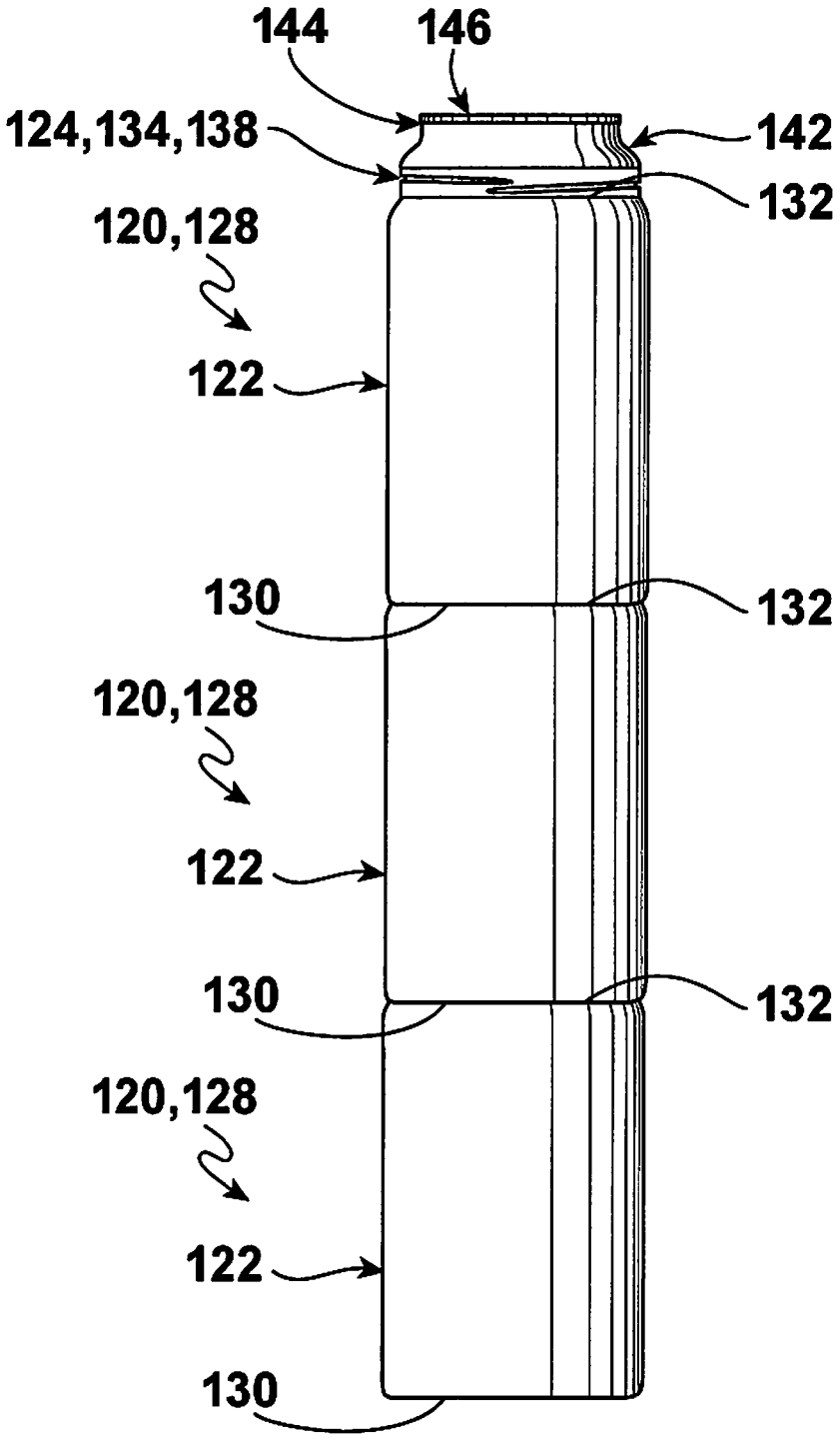
FIG. 10 is a side elevational view thereof illustrating three Stackable interlocking vessel interlocked and secured to each other.
Figure 11:
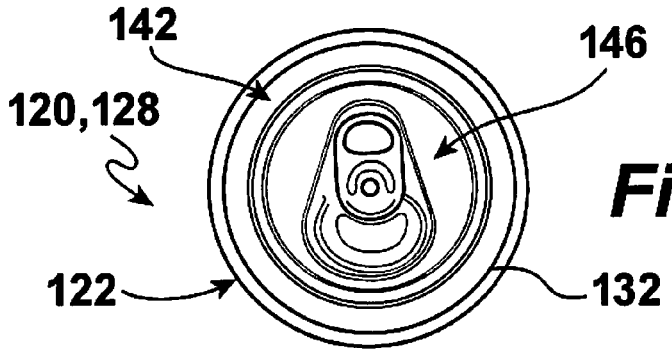
FIG. 11 is a top plan view thereof, of a vessel taken in the direction of arrow 11 in FIG. 8.
Figure 12:
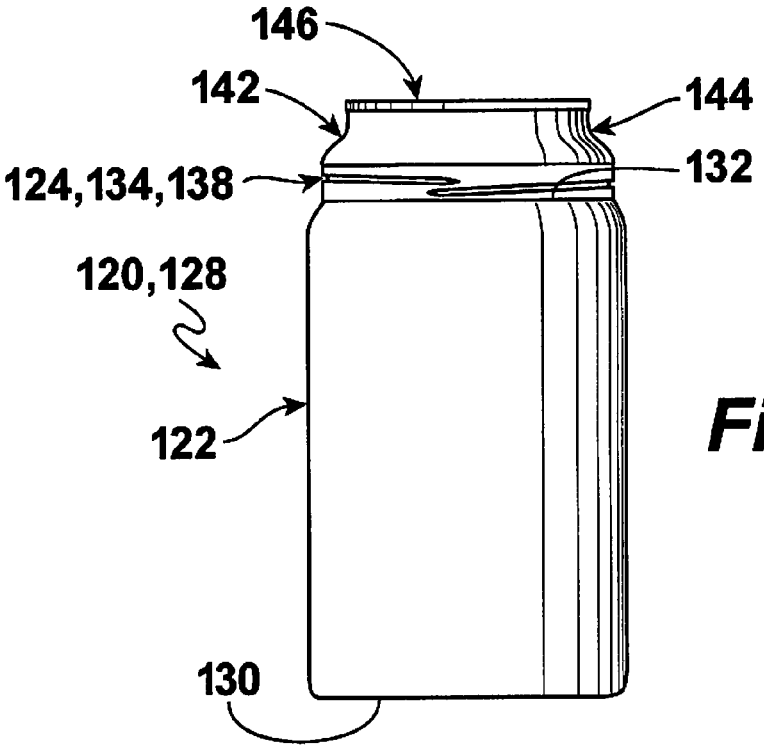
FIG. 12 is a side elevational view thereof, of a vessel taken in the direction of arrow 12 in FIG. 8.
Figure 13:
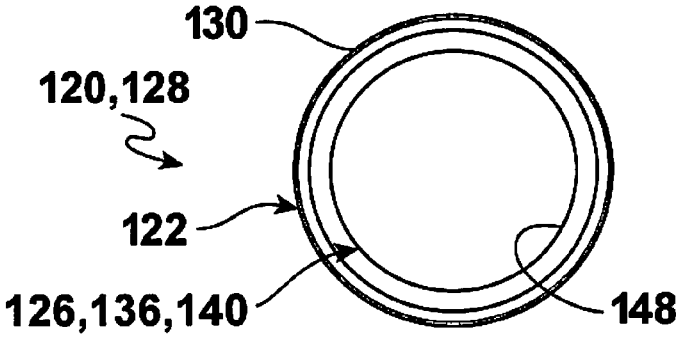
FIG. 13 is a bottom plan view thereof, of a vessel taken in the direction of arrow 13 in FIG. 8.
Figure 14:
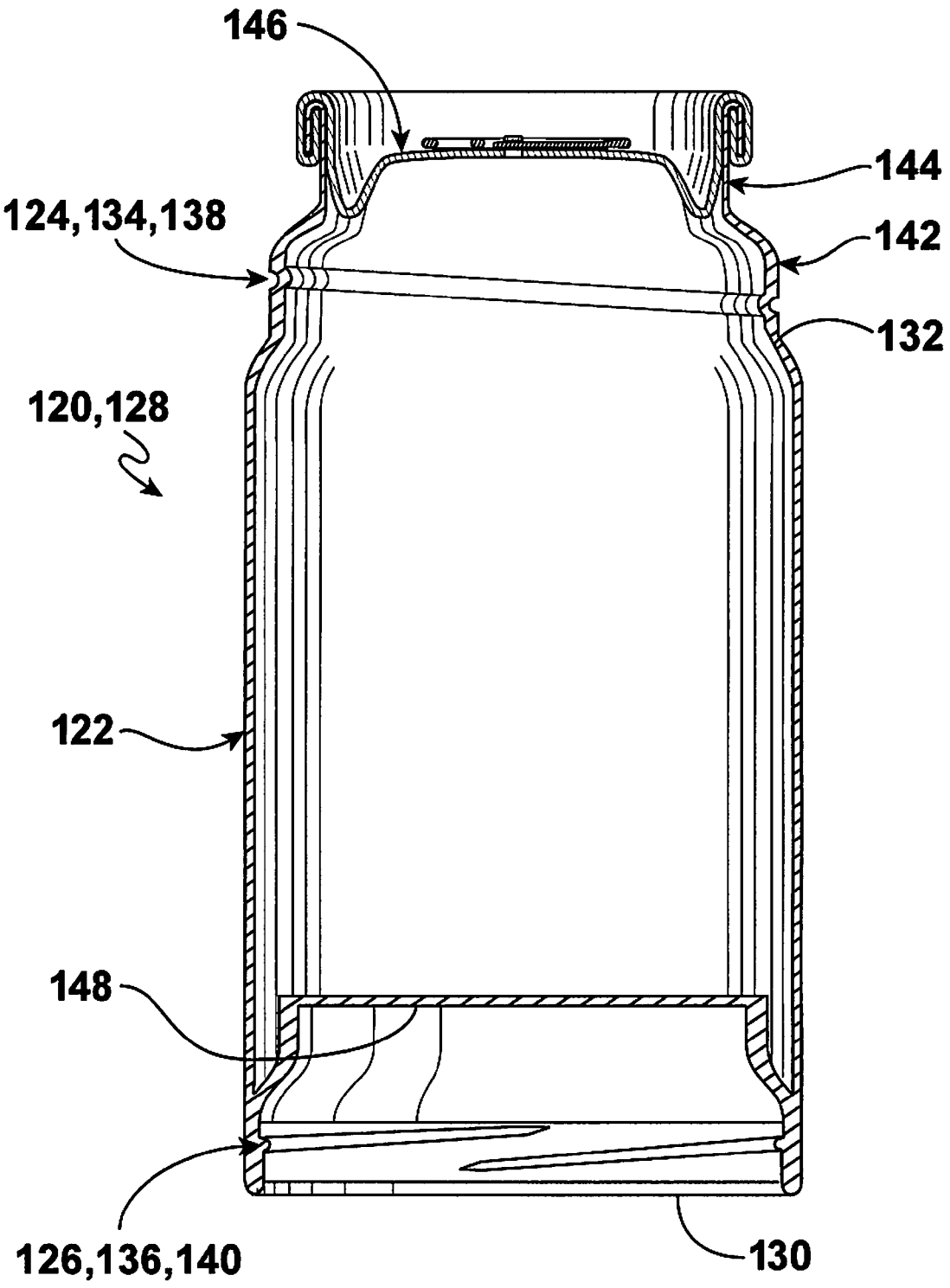
FIG. 14 is a cross sectional view thereof, taken along line 14-14 in FIG. 8.

Referring now to FIGS. 8-14, the container of the second embodiment of the present invention is shown generally at 120 for being interlockingly stackable and self-sealing.

The container 120 comprises a body 122, an upper interlock component 124, and a lower interlock component 126. The upper interlock component 124 extends outwardly from the body 122. The lower interlock component 126 extends inwardly from the body 122 and replaceably receives the upper interlock component 124 of a next lower container 120 so as to allow the container 120 to be interlockingly stacked and self-sealed.

The container 120 is a can 128.

The body 122 has a lowermost end 130 and an uppermost end 132.

The upper interlock component 124 extends outwardly, coaxially, and communicatingly from the uppermost end 132 of the body 122.

The lower interlock component 126 extends inwardly, coaxially, and communicatingly into the lowermost end 130 of the body 122.

The upper interlock component 124 includes threads 134.

The lower interlock component 126 includes threads 136.

The threads 134 of the upper interlock component 124 are male threads 138.

The threads 136 of the lower interlock component 126 are female threads 140.

The container 120 further comprises a circumferential shoulder 142.

The circumferential shoulder 142 extends coaxially, convergingly upwardly, and communicatingly from, and around, the upper interlock component 124.

The container 120 further comprises a neck 144.

The neck 144 extends coaxially upwardly and communicatingly from the circumferential shoulder 142.

The container 120 further comprises a pop-top 146.

The pop-top 146 is attached to the neck 144.

The circumferential shoulder 142, the neck 144, and the pop-top 146 form a general shape.

The lowermost end 130 of the body 122 further has a recess 148.

The recess 148 of the lowermost end 130 of the body 122 has a general shape to match the general shape of the circumferential shoulder 142, the neck 144, and the pop-top 146 so as to nestle the circumferential shoulder 142, the neck 144, and the pop-top 146 of a next lower container 120 therein, and be replaceably maintained therein, by the lower interlock component 126 of the container 120 threadably engaging the upper interlock component 124 of the next lower container 120.

It will be understood that each of the elements described above, or two or more together, may also find a useful application in other types of constructions differing from the types described above.

While the invention has been illustrated and described as embodiments of a stackable interlocking vessel, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A container for being interlockingly stackable and self-sealing, comprising:

a) a body;

b) an upper interlock component;

c) a lower interlock component; and d) a circumferential shoulder;

wherein said upper interlock component extends outwardly from said body;

wherein said lower interlock component extends inwardly from said body; and wherein said lower interlock component replaceably receives said upper interlock component of a next lower container so as to allow said container to be interlockingly stacked and self-sealed;

wherein said body has a lowermost end;

wherein said body has a circumferential wall;

wherein said lowermost end of said body has a recess;

wherein said recess of said lowermost end of said body is partially defined by a lowermost circumferential ring;

wherein said lowermost circumferential ring of said recess of said lowermost end of said body is spaced radially inwardly and concentrically from said circumferential wall of said body so as to form an open-topped circumferential ring therebetween that has a generally U-shaped cross section having a pair of radially spaced-apart circumferential walls defining an open-topped gap therebetween and a curved lowermost portion that connects said pair of radially spaced-apart circumferential walls to each other and which is disposed at said lowermost end of said body;

wherein said pair of circumferential walls comprise an inner circumferential wall and an outer circumferential wall;

wherein said inner circumferential wall has a straight vertical component;

wherein said open topped gap is partially disposed between said straight vertical component and said outer circumferential wall;

wherein said lower interlock component is disposed on said straight vertical component;

wherein said circumferential shoulder extends upwardly from said upper interlock component;

wherein said curved lowermost portion of said open-topped circumferential ring is entirely radially curved, and as such, has no straight portions;

wherein said open topped gap has a radial cross section;

wherein said open topped gap has an entire circumferential expanse therearound; and wherein said radial cross section of said open topped gap is unchanged along said entire circumferential expanse thereof.

2. The container of claim 1, wherein said container is one of a bottle and a can.

3. The container of claim 1, wherein said body has an uppermost end.

4. The container of claim 3, wherein said upper interlock component extends outwardly from said uppermost end of said body.

5. The container of claim 3, wherein said upper interlock component extends coaxially from said uppermost end of said body.

6. The container of claim 3, wherein said upper interlock component extends communicatingly from said uppermost end of said body.

7. The container of claim 1, wherein said lower interlock component extends inwardly into said lowermost end of said body.

8. The container of claim 1, wherein said lower interlock component extends coaxially into said lowermost end of said body.

9. The container of claim 1, wherein said lower interlock component extends communicatingly into said lowermost end of said body.

10. The container of claim 1, wherein said upper interlock component includes threads; and wherein said lower interlock component includes threads.

11. The container of claim 10, wherein said threads of said upper interlock component are male threads.

12. The container of claim 1, wherein said threads of said lower interlock component are female threads.

13. The container of claim 1, wherein said circumferential shoulder extends coaxially from said upper interlock component.

14. The container of claim 1, wherein said circumferential shoulder extends convergingly upwardly from said upper interlock component.

15. The container of claim 1, wherein said circumferential shoulder extends communicatingly from said upper interlock component.

16. The container of claim 1, further comprises a neck.

17. The container of claim 16, wherein said neck extends coaxially upwardly from said circumferential shoulder.

18. The container of claim 16, wherein said neck extends communicatingly from said circumferential shoulder.

19. The container of claim 16, further comprising one of a cap and a pop-top.

20. The container of claim 19, wherein said one of said cap and said pop-top is attached to said neck.

21. The container of claim 19, wherein said circumferential shoulder, said neck, and said one of said cap and said pop-top form a general shape.

22. The container of claim 21, wherein said recess of said lowermost end of said body has a general shape to match said general shape of said circumferential shoulder, said neck, and said one of said cap and said pop-top so as to nestle said circumferential shoulder, said neck, and said one of said cap and said pop-top of a next lower container therein, and be replaceably maintained therein, by said lower interlock component of said container threadably engaging said upper interlock component of said next lower container.

* * * * *